US006126487A

United States Patent [19]

Rosenberger

[11] Patent Number: 6,126,487

[45] Date of Patent: Oct. 3, 2000

[54] COAXIAL CONNECTOR SOCKET

[75] Inventor: Bernhard Rosenberger, Tittmoning, Germany

[73] Assignee: Rosenberger Hochfrequenztechnik GmbH and Co., Fridolfing, Germany

[21] Appl. No.: 09/018,461

[22] Filed: Feb. 4, 1998

[30] Foreign Application Priority Data

Feb. 4, 1997 [DE] Germany ..... 297 01 944 U

[51] Int. Cl.[7] ..... H01R 33/20; H01R 24/00

[52] U.S. Cl. ..... 439/675; 439/851

[58] Field of Search ..... 439/675, 851, 439/578

[56] References Cited

U.S. PATENT DOCUMENTS 4,431,253 2/1984 Hochgesang ..... 439/675

*Primary Examiner*—Neil Abrams

*Assistant Examiner*—Javaid Nasri

*Attorney, Agent, or Firm*—Lowe, Hauptman, Gopstein, Gilman & Berner, LLP

[57] ABSTRACT

A coaxial plug-and-socket connector has an external-conductor contact-socket for engaging a mating plug external-conductor. The socket has an end face through which the mating-plug external-conductor passes. The external-conductor contact-socket has a bushing with a metal wall with an axial slit. The wall at the bushing end face is compressed in such manner that it conically tapers toward the mating-plug external-conductor. The opposite wall segments at the slit partly overlap so the bushing has a frusto-conical shape and spring properties.

11 Claims, 4 Drawing Sheets

COAXIAL CONNECTOR SOCKET

FIELD OF THE INVENTION

The present invention relates generally to coaxial female connector sockets and more particularly to a coaxial female connector socket having a frustoconical exterior metal sleeve with spring characteristics.

BACKGROUND ART

A prior art female coaxial connector socket for receiving a mating male coaxial connector plug includes a cylindrical tube into which a cylindrical tube of the mating plug is screwed. There are other types of coaxial male plug and female socket connector combinations wherein a connection is automatically established when the plug is inserted into the socket. In such structures, a screw connection is usually not implemented. In one prior art structure a spring cage is mounted in a cylindrical socket of the male plug outer metal sleeve to provide connections between the socket and plug without screw action. Such a cage establishes elastic contact between outer tubular conductors of the male and female connector members. The connection is established by plural discrete and elastical mating strips that establish an elastic contact between the male and female connector members.

However, when the coaxial male plug and female socket connections are automatically established by inserting a module or cassette into a corresponding insertion frame, a problem is frequently encountered in that the plug parts must be floatingly supported with a given play in an insertion frame. In addition, the inserted module must have provision for mechanical connector tolerance compensation. However, with known connectors, frequently the connector female socket and mating male plug are not precisely axially aligned. Consequently, the plug outer conductor sleeve makes poor contact with the outer conducting sleeve of the female socket. The poor contact enables electromagnetic energy, particularly energy in the Gigahertz region, to escape from the connector. In addition, such a coaxial connection is quite likely to malfunction because it is highly susceptible to poor contact conditions due to vibrations. If the male and female connector parts are frequently plugged into and removed from each other, the connection frequently fails entirely as a result of wear. In addition, a floating support of the corresponding elements is complex and costly to make because the contact is implemented by springs.

Accordingly, an object of the present invention is to provide a new and improved coaxial socket for a plug-in socket connector, wherein the plug-in socket connector prevents escape of high-frequency electromagnetic fields, particularly in the Gigahertz range, and establishes a low loss connection between the male and female connector elements.

Another object of the invention is to provide a new and improved relatively inexpensive coaxial socket that is highly reliable in use and easily manufactured and wherein a male element is easily inserted into the female element without any screwing action.

A further object of the invention is to provide a new and improved relatively inexpensive coaxial connector socket having few parts.

SUMMARY OF THE INVENTION

The socket of the present invention includes a bushing having an end face through which a mating male plug is inserted. The bushing has a frustoconical wall formed by making an axial slit in a tube having a constant radius cross-section to form a pair of wall segments that are forced together and bonded so they taper conically toward the end face. Mutually opposite portions of the wall adjacent the slit overlap at least partially in a zone adjacent the end face.

The frustoconical bushing of the present invention is advantageous because it provides a complete and close contact around a mating male plug outer tubular conductor. Thereby, undesired openings which permit high frequency electromagnetic fields to leak in prior art coaxial connectors are precluded. In this design, the contact remains closed even when the coaxial connector socket and the mating plug are not precisely axially aligned. Canting by the mating plug is correspondingly compensated. These results are achieved by an elastic, i.e., spring, support resulting from the slitted frustoconical construction of the bushing.

A further advantage of the design is that contact between the bushing of the female connector socket and the outer tubular conductor of the mating plug is always defined and maintained in a predetermined position. As a result, the coaxial connector socket of the present invention can be used with existing commercial plugs, which meet existing standards and do not require modification. Because of the reliable and close contact between the external tubular conductors of the male plug and female socket, high frequency electromagnetic energy coupled through the connector, for instance at radio frequencies in the 5 to 20 Gigahertz range and above, is effectively shielded by the connector. In addition, the radio frequency shielding provided by the socket and plug combination does not change substantially even when the mating plug is not fully inserted or is obliquely inserted into the coaxial female connector socket.

Especially good and reliable contact between the external tubular conductors of the socket and plug is obtained because the diameter of the sleeve of the mating plug corresponds approximately to the diameter of the external tubular frustoconical conductor of the socket. In particular, the plug tubular external conductor has a diameter slightly less than the diameter of the frustoconical bushing.

Improved insensitivity to mechanically improper insertion of the male plug into the female socket is achieved by selecting the thickness of the wall of the bushing in such a manner that overlapping segments of the bushing wall resiliently bear against the external tubular conductor of the mating plug.

Since the slit is flared, particularly in an arcuate manner, at its end remote from the mating plug, the bushing is virtually stress-free and mechanically strong. By placing the slit a predetermined distance from the end of the bushing remote from the end face of the bushing through which the mating plug is inserted, the coaxial connector socket of the present invention provides especially good electrical contact properties and attenuating properties for high frequency energy coupled through the connector.

In a particular embodiment of the invention, the female socket is used in a feedthrough adapter inserted in openings of a wall. Such an adapter includes two mutually opposed coaxial connector sockets including the above-mentioned features. The feedthrough adapter includes a housing enclosing both coaxial connector sockets. The housing is fitted with a tubular external conductor connection structure between a pair of bushings of the type described. The housing is made of one piece and is relatively inexpensive, preferably formed of plastic by an injection-molding process. A centering ring is preferably mounted in front of each bushing to provide especially reliable insertion of the male mating plug into each coaxial female connector socket.

Each female socket preferably has a centering ring adjacent the bushing end face through which the male plug is inserted. The centering ring assists in providing especially reliable insertion of the mating plug into the housing. The centering ring has a bevelled outer rim to enhance contact between the socket and the plug.

The above and still further objects, features and advantages of the present invention will become apparent upon consideration of the following detailed description of one specific embodiment thereof, especially when taken in conjunction with the accompanying drawings.

DESCRIPTION OF THE PREFERRED EMBODIMENT

Figure 1:
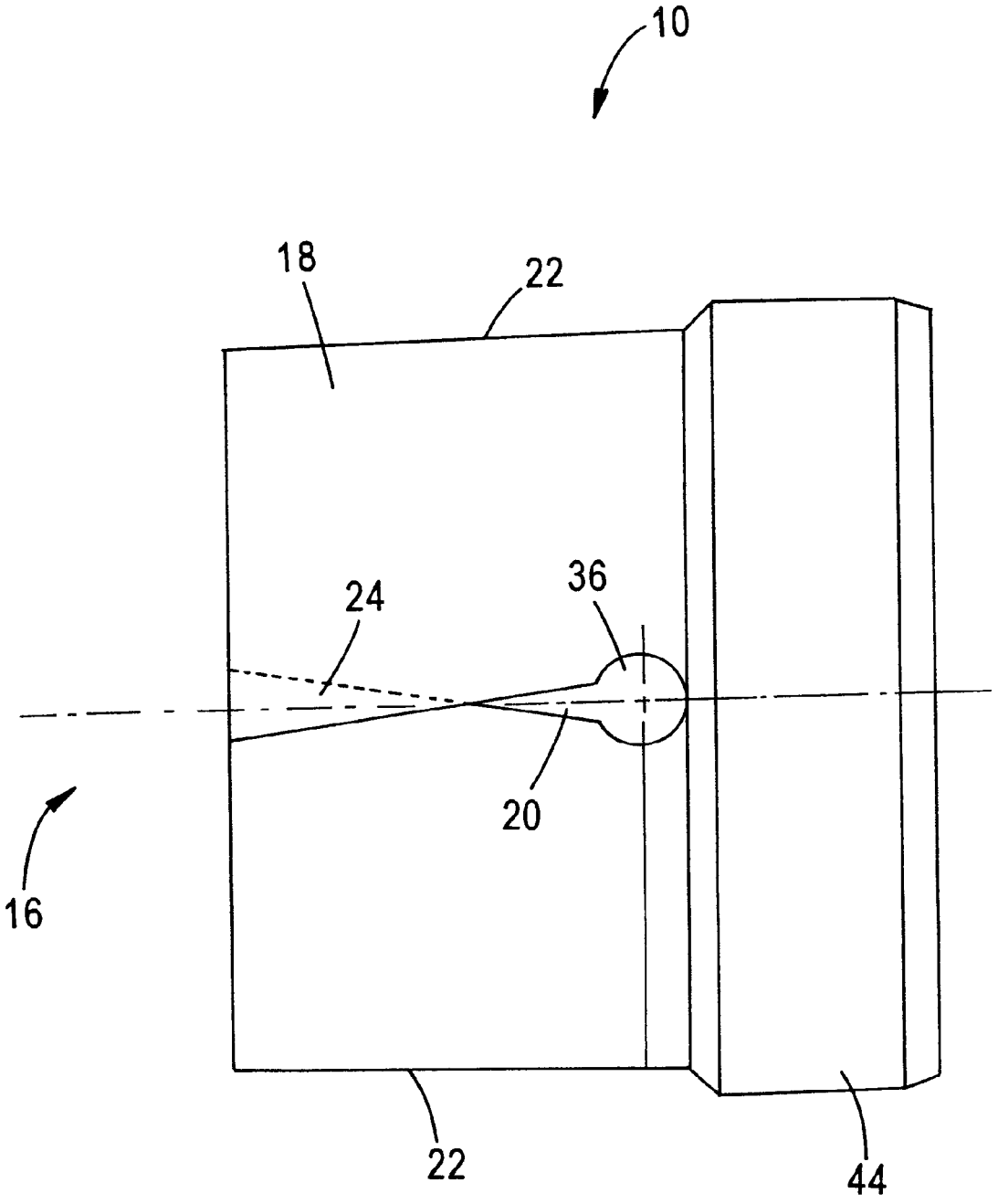
FIG. 1 is a side view of a preferred embodiment of a bushing in accordance with a preferred embodiment of the invention.

The female coaxial conductor contact socket 10 illustrated in FIG. 1 includes a bushing 18 having a flexible, sheet metal, frustoconical tubular wall 22 having an open end face 16 and a circular opening 36, located remotely from face 16. Collar 44, having a diameter greater than the diameter of all segments of bushing 18, is located at an end of socket 10 remote from end face 16. Slit 20 extends longitudinally along bushing 18 from opening 36 to end face 16. The ends of wall 22 adjacent end face 16 are compressed toward each other to form overlapping region 24, that extends from end face 16 to a point about two-thirds of the way from end face 16 to circular opening 36. The ends of wall 22 in overlapping zone 24 are bonded to each other, for example, by soldering. For clarity, the width of slit 20 and the size of overlapping zone 24 are exaggerated in FIG. 1.

Open end face 16 receives a male coaxial connector plug (not shown in FIG. 1) which mates with bushing 18. Because bushing 18 has spring-like characteristics and a frustoconical configuration thereof, wherein the diameter of bushing 18 at end face 16 is somewhat smaller than the bushing diameter at the bushing end adjacent collar 14, satisfactory connections are established between the male and female coaxial connector structures even if (1) the male structure is not fully inserted into the female structure and/or (2) the longitudinal axes of the male and female connector structures are canted somewhat with respect to each other.

Figure 2:
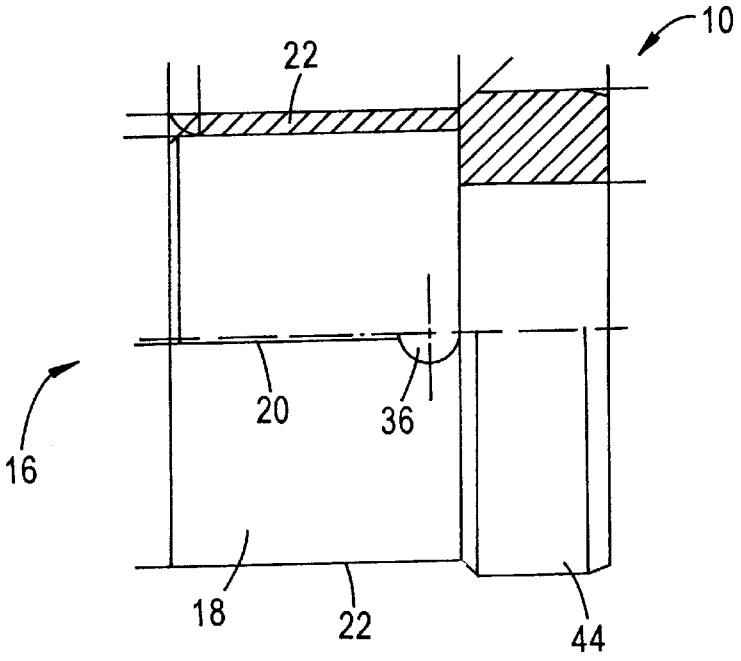
FIGS. 2 and 3 are partial cross-sectional elevation views of the bushing illustrated in FIG. 1, during first and second fabrication steps, respectively.
Figure 3:
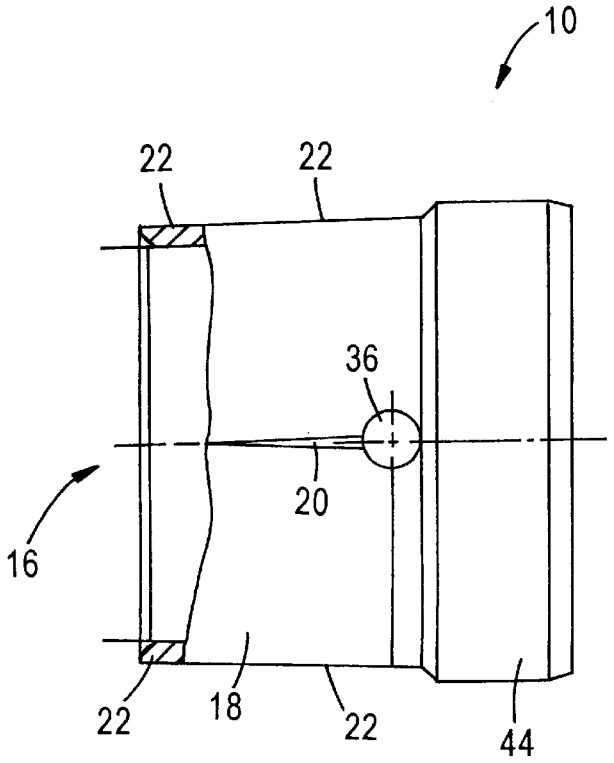

FIGS. 2 and 3 are respectively illustrations of the configurations of bushing 18 during first and second bushing manufacturing steps. Initially, and prior to the first step of FIG. 2 being reached, bushing 18 has a cylindrical wall. During the first step illustrated in FIG. 2, circular hole 36 and slot 20 are formed on the bushing cylindrical wall. After slot 20 and hole 36 are formed, the opposite edges of slit 20 remain parallel to each other and extend longitudinally of bushing 18.

During the second step, illustrated in FIG. 3, the two segments of wall 22 are compressed toward each other at end face 16 so the two segments of wall 22 taper conically toward end face 16 and at least partially overlap in zone 24. Then, the two segments of wall 22 in overlapping zone 24 are bonded to each other, e.g., by soldering.

The stated construction causes bushing 18 to exert a resistance force and a retaining force on the male connector plug inserted into the socket formed by the bushing. The structure is such that the plug-in and retaining forces act radially as they do in typical prior art coaxial plug and socket connectors having a spring cage and a cylindrical configuration. In addition, the plug-in and retaining forces act circumferentially of the bushing. Because the plug-in and retaining forces act both radially and circumferentially, the plug-in and retaining forces are not discretely restricted to given points where there is contact between the male and female connector structures. Instead, the plug-in and retaining forces between female socket 10 and the male plug are uniformly and continuously distributed around the circumference of socket 10. As a result, socket 10 is relatively insensitive to mechanical plug-in defects, such as incomplete insertion of the plug into socket 10 and/or oblique insertion of the plug into the socket.

Figure 4:
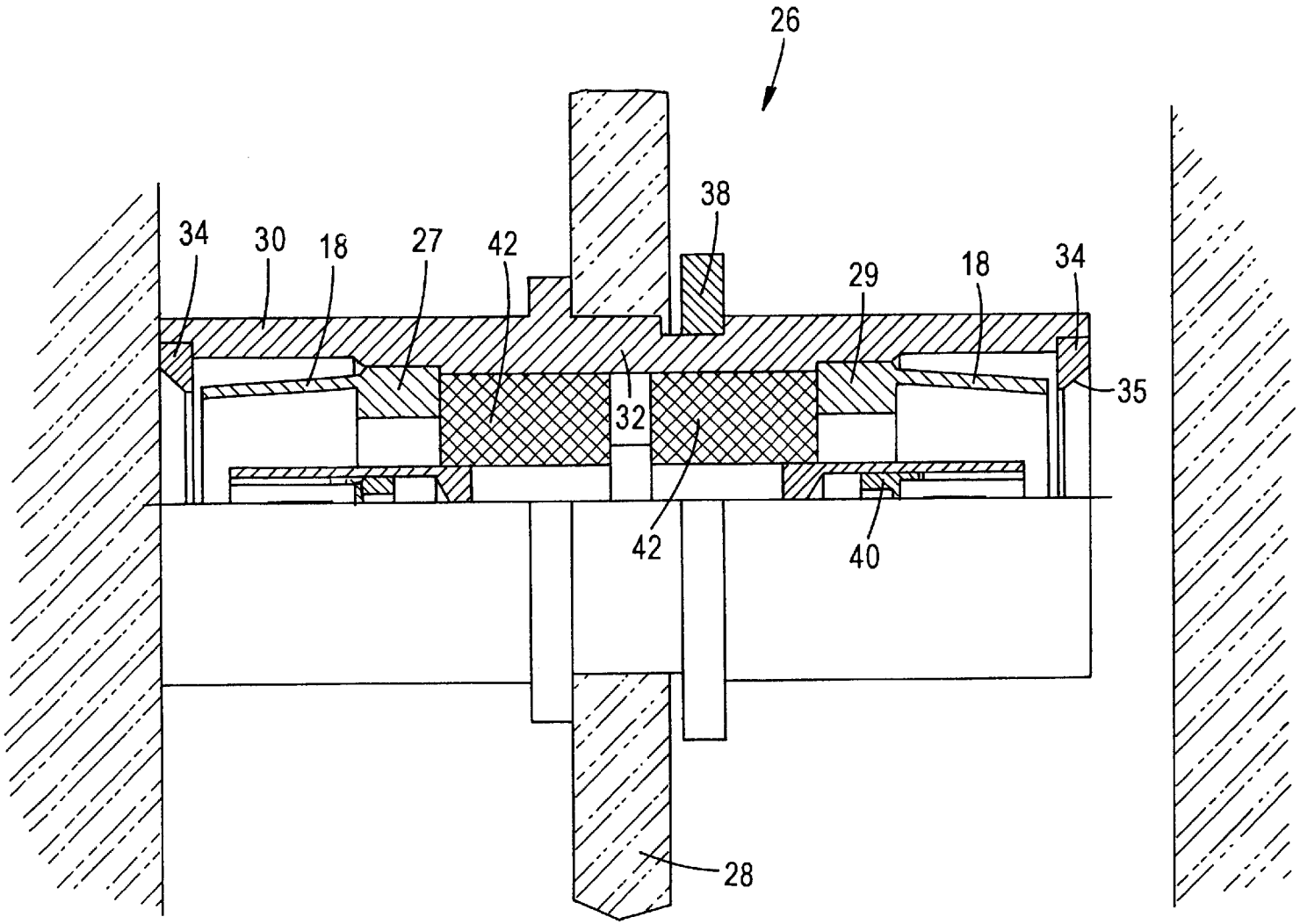
FIG. 4 is a partial cross-sectional elevation view of a feedthrough adapter including two sockets containing the bushing illustrated in FIG. 1, according to a preferred embodiment of the invention, without mating plugs inserted therein.

Feedthrough adapter 26, FIG. 4, includes female coaxial connector sockets 27 and 29 on opposite sides of wall 28 through which the adapter extends. Each of female connector socket 27 and 29 is configured the same as connector 10, FIGS. 1 and 3. Feedthrough adapter 26 also comprises tubular, longitudinally extending, metal one piece housing 30 having a center region 32 mechanically and electrically connecting female sockets 27 and 29 together. Adapter 26 also contains inner metal, longitudinally extending tubular center conductor 40, and tube 42, made of electrical insulating material. Tube 42 has exterior and interior cylindrical walls respectively abutting the interior cylindrical wall of center region 32. The stated construction provides a secure, stable fit between conductor 40, tube 42 and housing 30 and the interior end portions of the cylindrical exterior wall of tubular conductor 40.

The open opposite ends of housing 30 include seats carrying metal centering rings 34 through which the male coaxial connector plugs extend. Rings 34 have inwardly tapered, bevelled, faces 35 having inner diameters approximately equal to the inner diameters of bushings 18, at end faces 16. Hence, centering rings 34 help to guide the male coaxial connector plugs into female connector sockets 27 and 29.

Adapter 26 also includes metal securing ring 38, threaded into threads in a groove on the periphery of housing 30; the threads are slightly longitudinally displaced from the housing center. Housing 30 includes radially extending flange 39 which is slightly longitudinally displaced from the center of the housing, on the side of the housing opposite from ring 38. Ring 38 is adjusted so a face thereof abuts a face of wall 28 while a face of flange 39 abuts the opposite face of wall 28 to hold the adapter in place against the wall. Hence, feedthrough adapter 26 is supported in a floating manner and with play at wall 28, as a result of the action of securing ring 38 and flange 39.

The device illustrated in FIG. 4 is used in a rack for plug-in modules (not shown). The modules are inserted in such a rack from the right and from the left, as illustrated in FIG. 4. The modules include appropriately situated male connector plugs. When the modules are inserted into the rack, the module male connector plugs engage bushings 18 of female sockets 27 and 29.

Figure 5:
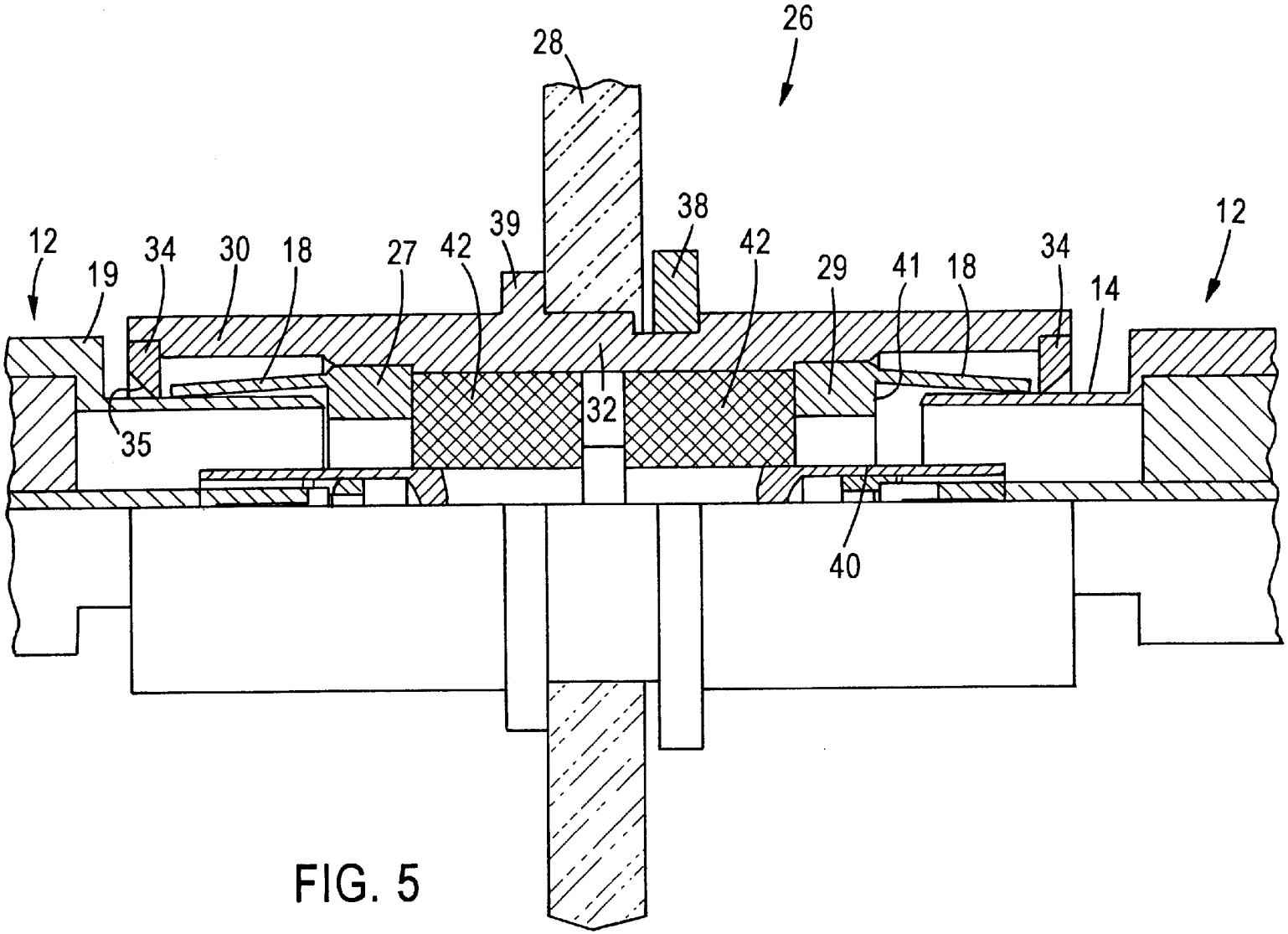
FIG. 5 is a partial cross-sectional elevation view of the feedthrough adapter of FIG. 4 in combination with two male coaxial connector plugs, one of which is completely inserted into one socket of the adapter and a second of which is only partially inserted into the other socket of adapter.

FIG. 5 is a drawing showing how male coaxial plugs 12 mate with and are forced from both sides into a mating relation with bushings 18 and inner metal tubes 40 of female coaxial sockets 27 and 29 of feedthrough adapter 26. On the left side of FIG. 5, the mating male coaxial plug 12 is shown as being fully inserted into bushing 18 of female coaxial socket 27. In contrast, on the right side of FIG. 5, external tubular surface 14 of male connector plug 12 contacts the wall of bushing 18 of female connector 29 at and close to the open end face of the bushing.

In prior art adapters having cylindrical metal female bushings (instead of the frustoconical spring bushings 18 of the present invention) proper connections frequently are not established between the bushing and the tubular metal exterior sleeve of a male coaxial connector plug, such as tube 14 of plug 12. The mechanical tolerances of the cylindrical female bushings and of the tubular metal sleeves frequently preclude proper connections if the male connector plug is not fully inserted into the cylindrical bushing or if the male plug is inserted into the female socket in such a manner that the male plug and female socket longitudinal axes are canted relative to each other.

For the properly inserted male connector plug 12 illustrated on the left side of FIG. 5, the exterior of tubular wall 14 abuts the interior, inner diameter of ring 34 and the end portion of bushing 18, as well as a portion of the bushing removed from the bushing end face. In addition, there is contact between the open end of wall 14 against the face of collar 44 of female connector socket 27. Thereby, a bilaterally accurate plug-socket connection is established by the structure illustrated on the left side of FIG. 5.

On the right side of FIG. 5, tubular wall 14 of male connector 12 is inserted only partially into bushing 18 of female connector socket 29. In addition, the longitudinal axis of male connector 12 is canted somewhat with respect to the longitudinal axis of female plug 29. Prior art devices using known coaxial sockets frequently fail to operate correctly when the connector is inserted as illustrated on the right side of FIG. 5 because they lack adequate tightness at high r.f. frequencies, particularly in the gigahertz range of 5 to 20 gigahertz and above. In addition, the prior art devices have poor contact reliability and fail to have adequate shield attenuation in the gigahertz range, i.e., they permit the gigahertz radiation to escape from the connector.

The frustoconical bushing 18 of the invention enables satisfactory contact to be made even though the male plug is not fully and properly inserted into the female socket, as illustrated on the right side of FIG. 5. Exterior metal tube 14 of metal connector plug 12 on the right side of FIG. 5 is only partially inserted into frustoconical bushing 18 of female connector socket 29. The end of external metal tubular conductor 14 of male mating plug 12 does not abut the inner end wall 41 of socket 10; instead, the end of conductor 14 is spaced from wall 41, as illustrated. Contact between external tubular conductor 14 and bushing 18 occurs between an end portion of the frustoconical interior wall of the bushing and a central portion of the exterior wall of tubular conductor 14. Bushing 18 is spring loaded against external conductor 14 by slit 20 (FIG. 1), the frustoconical shape and the spring characteristics. FIG. 5 shows that the contact point between tube 14 and bushing 18 is independent of (1) the depth male mating plug 12 is inserted into female socket 29 and (2) canting of the longitudinal axis of plug 12 relative to the longitudinal axis of feedthrough adapter 26. Within given tolerances, there is always a reliable contact surface between the interior frustoconical wall of bushing 18 around the circumference of the exterior tubular, constant radius outer conductor wall 14 of mating plug 12.

Because of the shape and spring effects of bushing 18, there is effective compensation for insertion defects caused by offsets between the longitudinal axes of feedthrough adapter 26 and mating plug 12 cause by (1) canting between adapter 26 and mating plug 12 and/or (2) mating plug 12 being only partially inserted into bushing 18 of adapter 26. The electrical properties of the plug and socket connection provided by adapter 26 are not substantially affected by such defects. Thereby, high frequency characteristics of the plug and socket connector of FIG. 5 are substantially improved and the susceptibility of connector malfunctioning is considerably reduced.

The dimensions of feedthrough adapter 26 and the play of floating support in wall 28 are appropriately selected so transmission properties, such as attenuation of stray electromagnetic fields by the shield established by the connection of bushing 18 to tube 14, remain constant for up to 0.85 mm defective entry of mating plug 12. In other words, the dimensions and floating support are such as to preclude defective entries of male plug 12 into female socket 10 of up to 0.85 mm.

Slit 20 and the correspondingly compressed walls 22 at end face 16 of bushing 18 act as an iris when a mating male plug is inserted into bushing 18 of female socket 10. End face 16 of bushing 18 exerts a resilient compressive force continuously around the external tubular conductor 14 of plug 12. Thereby, a continuous contacting surface is established around the circumference of external conductor 14. Because the circumference of bushing 18 increases as mating plug 12 is being inserted into the bushing, contact between the bushing and plug is "softer" than in the prior art connector and pressure spots which occur in the prior art designs and may cause connector malfunctioning are precluded by the invention.

Overlap zone 24 is preferably as short as possible to prevent the outer shape of bushing 18 from deviating unduly from a cylindrical shape. Also, slit 20 and short bushing 18 are preferably relatively short in the longitudinal direction.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A socket of a coaxial plug-and-socket connector comprising an external-conductor contact-socket for engaging a mating-plug external-conductor, the external-conductor contact-socket including a bushing having a tubular wall including an end face for mating with and receiving the mating-plug external-conductor, the bushing wall including an axial slit, the wall being compressed in such manner that at said end face it conically tapers toward the mating-plug external-conductor, segments of the wall mutually opposite the slit overlapping each other at least partly.

2. The socket as claimed in claim 1 wherein the diameter of the end face approximately corresponds to the diameter of the mating-plug external conductor.

3. The socket as claimed in claim 2 wherein the end face diameter is slightly smaller than the diameter of the mating-plug external conductor.

4. The socket as claimed in claim 1 wherein the bushing wall thickness is such that the mutually overlapping wall segments of the bushing resiliently bear against the mating-plug external conductor.

5. The socket as claimed in claim 1 wherein the slit ends at a circular opening remote from the end face.

6. The socket as claimed in claim 1 wherein the slit is spaced by a predetermined distance from the end of the bushing away from the mating plug.

7. A feedthrough adapter in particular for wall feedthrough, comprising two mutually opposite coaxial plug-and-socket connector sockets constructed in accordance with claim 6.

8. The feedthrough adapter as claimed in claim 7 wherein the adapter comprises a housing enclosing both coaxial plug-and-socket sockets, the housing having an external mechanical connection between two bushings.

9. The feedthrough adapter as claimed in claim 8 wherein the housing is made of one piece.

10. The feedthrough adapter as claimed in claim 8 further including a centering ring mounted adjacent the bushing open end face.

11. The feedthrough adapter as claimed in claim 10 wherein the centering ring has a bevelled outer end.

* * * * *